US007384175B2

(12) United States Patent
Sandell

(10) Patent No.: US 7,384,175 B2
(45) Date of Patent: Jun. 10, 2008

(54) WORKLIGHT WITH INTEGRAL SPARE BULB STORAGE

(75) Inventor: Donald R. Sandell, San Jose, CA (US)

(73) Assignee: EML Technologies LLC, Danville, CA (US)

( * ) Notice: Subject to any disclaimer, the term of this patent is extended or adjusted under 35 U.S.C. 154(b) by 0 days.

(21) Appl. No.: 11/419,754

(22) Filed: May 22, 2006

(65) Prior Publication Data

US 2007/0268690 A1 Nov. 22, 2007

(51) Int. Cl.
*F21S 8/08* (2006.01)

(52) U.S. Cl. ..... 362/410; 362/207; 362/376

(58) Field of Classification Search ..... 362/184, 362/190, 191, 207, 376, 377, 378, 410, 414, 362/457; 206/418, 419
See application file for complete search history.

(56) References Cited

U.S. PATENT DOCUMENTS 1,680,169 A * 8/1928 Osean ..... 362/207
4,858,763 A * 8/1989 Scott ..... 206/419
5,695,278 A 12/1997 Grossman et al.
5,845,989 A 12/1998 Leen
6,050,710 A 4/2000 Grossman et al.
6,416,206 B1 7/2002 Leen
6,450,660 B1 9/2002 Lee
6,921,185 B2 7/2005 Monroe et al.

* cited by examiner

*Primary Examiner*—Y M. Lee
(74) *Attorney, Agent, or Firm*—Elliot B. Aronson

(57) ABSTRACT

A worklight with spare bulb storage that is integrated storage into the existing worklight framework. Many worklights have one or more worklight heads supported on a base, which includes one or more generally hollow elongate cross bar structural support members. The spare bulb holder is integrated into the one or more of the cross bar structural support members and includes one or more spare-bulb retainers and a retainer support piece. The retainer itself has an elongate extent with an end cap at one end and is formed to hold an individual elongate double-ended halogen bulb. The retainer support piece is retained in an end of a cross bar structural support member and has at least one opening sized so that the retainer can be inserted through it into the cross bar structural support member. The end cap on the retainer is formed to close the opening through the retainer support piece and to be held securely within the opening when the retainer is inserted into the cross bar structural support member. In a preferred embodiment the retainer support piece is formed of a single plastic piece that is shaped to be merely pressed into an open end of a cross bar structural support member that is already necessarily present in the worklight assembly.

1 Claim, 1 Drawing Sheet

WORKLIGHT WITH INTEGRAL SPARE BULB STORAGE

BACKGROUND OF THE INVENTION

The present invention relates to halogen worklights and is more particularly directed to arrangements for including one or more spare halogen bulbs with a worklight.

Halogen worklights have become popular for use in such varied settings as construction jobs, industrial plants, automotive and auto body repair shops, artist and photographic studios, and projects around the home. Halogen bulbs have a comparatively high operating temperature and consequently a limited life, and it is not uncommon for them to burn out while in use on the job. When a bulb fails on the job, it interrupts the project at hand and usually has to be replaced before the work can continue. Thus, it is desirable to have a spare bulb handy.

The typical halogen bulb used in such worklights is a double-ended bulb with a slender elongate envelope having electrical contacts at opposite ends that are shaped for mechanically mounting the bulb in the worklight. U.S. Pat. No. 5,695,278 of Grossman et al. recognized the desirability of storing a spare bulb with the worklight itself. This patent incorporates a spare bulb storage compartment into a tubular handle of the worklight. The handle runs from side to side essentially the width of the worklight head and is conveniently the right size and shape to hold a spare bulb. U.S. Pat. No. 5,845,989 of Leen shows a dedicated elongate tubular housing for a spare halogen bulb that is attached to a worklight at a bracket support for the worklight head. This tubular housing includes a pair of removable end pieces that can be removed to open the housing at either end. The end pieces themselves are formed with longitudinal holes for holding the ends of the halogen bulb. The end pieces frictionally engage the ends of the bulb to hold the bulb securely in the tubular housing. U.S. Pat. No. 6,416,206 of Leen also discloses a tubular housing secured to the same head-supporting bracket. The '206 patent recognizes a problem with the earlier U.S. Pat. No. 5,845,989 in that the end pieces can get dislodged and lost, thus rendering the spare bulb holder unusable. The '206 patent discloses a dedicated tubular housing that employs only a single removable end cap at one end and that is closed at the other end. U.S. Pat. No. 6,050,710 of Grossman et al. shows a worklight in which a dedicated tubular bulb storage container is affixed to or molded into the housing of the worklight head itself on the underside of the head. U.S. Pat. No. 6,450,660 of Lee also discloses the notion of storing a spare bulb in an elongate tubular spare bulb housing and further discloses an arrangement for supporting a double-ended halogen bulb in the elongate tubular housing. In particular, spare bulbs are housed in tubular-shaped support feet forming part of the worklight base. U.S. Pat. No. 6,921,185 of Monroe et al. discloses a storage compartment for holding a single spare bulb that is incorporated into the interior of the frame or bezel on the front of the worklight head and that is accessible when the head is opened up and the frame is separated from the rest of the worklight head.

These prior art approaches have generally sought to store the spare bulb in a piece of tubing that has a free end such as a handle or leg of the worklight or in a piece of dedicated tubing that is attached to the worklight, except for U.S. Pat. No. 6,921,185, which instead stores the spare bulb in a hidden compartment in a specially manufactured front frame.

SUMMARY OF THE INVENTION

The present invention provides a worklight with spare bulb storage that does not require a special spare bulb housing to be separately manufactured, but rather integrates the spare bulb storage into the existing worklight framework. This is achieved by taking advantage of structures already available in the worklight assembly itself and thus calls for a minimum of additional fabrication or assembly steps in the manufacture of the spare bulb holder. In a preferred embodiment the extra storage is achieved with only a minor change in a single component of the worklight assembly. This has the advantages of particularly low cost of fabrication and ease of assembly and thus is achieved with minimal change in the manufacturing cost of the worklight as a whole. Moreover, the storage is not generally limited to a single bulb, but in general provides storage for two or, in some embodiments, more bulbs.

Briefly, many worklights have one or more worklight heads supported on a base, which includes one or more generally hollow elongate cross bar structural support members. The spare bulb holder is integrated into the one or more cross bar structural support members. The spare bulb holder includes one or more spare-bulb retainers and a retainer support piece. The retainer itself has an elongate extent with an end cap at one end and is formed to hold an individual elongate double-ended halogen bulb. The retainer support piece is retained in an end of a cross bar structural support member and has at least one opening sized so that the spare-bulb retainer can be inserted through the opening into the cross bar structural support member. The end cap on the retainer is formed to close the opening through the retainer support piece and to be held securely within the opening when the retainer is inserted into it. In a preferred embodiment the retainer support piece is formed of a single plastic piece that is shaped to be merely pressed into an open end of a cross bar structural support member that is already necessarily present in the worklight assembly.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
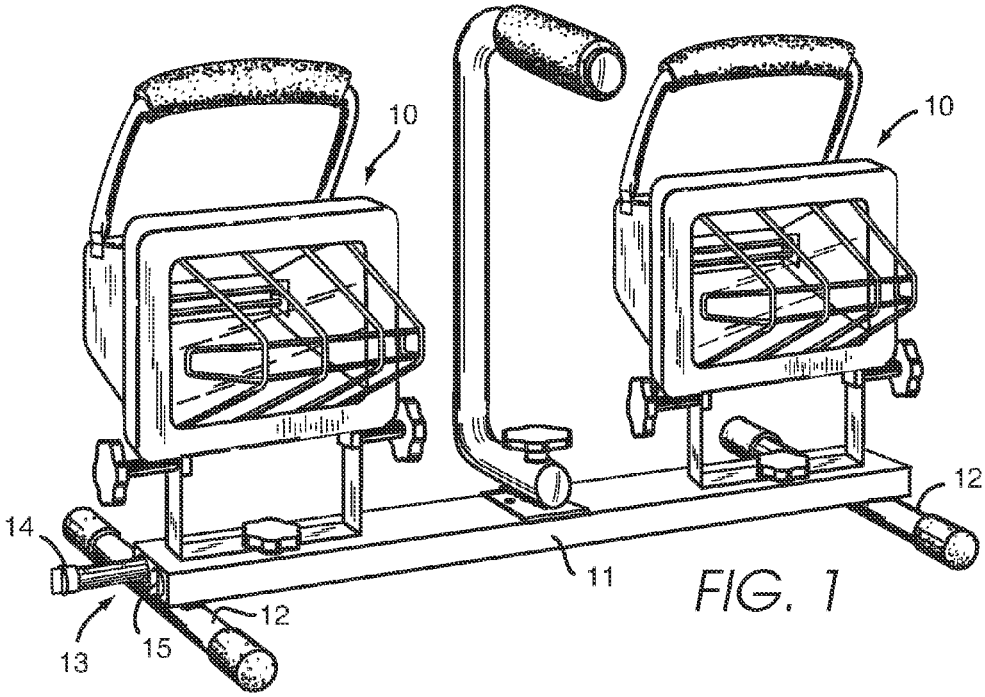
FIG. 1 is an overall perspective view of a halogen worklight with an embodiment of integral dual spare bulb holder in accord with the invention.

FIG. 1 shows an overall view of a common embodiment of worklight assembly into which a dual spare bulb holder has been integrated. The illustrated worklight assembly includes a pair of worklight heads 10 mounted on a base comprising a generally hollow elongate cross bar 11 and a pair of foot members 12 for setting the worklight on the ground or other work surface. A spare bulb holder may also be integrated into a number of other worklights of the prior art, in which the base may take a variety of forms. In some worklights intended to be used only on a tripod, for example, the base may consist of the cross bar alone adapted in its central region to be affixed to the tripod. In other worklights the cross bar may be secured to a more involved arrangement than the simple foot members 12 for supporting the worklight on the work surface and/or on a tripod. In yet other worklight embodiments the base may include two different cross bar support members—one to which the worklight heads are secured, and the other to which the tripod is secured or foot members are secured. In yet other embodiments the base may include three or more cross bar support members defining a platform on which multiple worklight heads may be mounted.

In all these embodiments the cross bar serves as a structural support member integral to the worklight base and is necessarily present either as a support on which one or more worklight heads are mounted, or as a support for the worklight assembly as a whole on a tripod or on a foot member arrangement. In the example of FIG. 1 the single cross bar support member serves both support functions. Such support members are referred to herein a cross bar structural support members. The present invention takes advantage of this necessary presence of a cross bar structural support member to provide a housing for spare bulb storage with little if any additional manufacturing cost and without having to manufacture an add-on structure separately secured to the worklight assembly for the dedicated purpose of spare-bulb storage.

The cross bar, which serves double duty here as a spare-bulb housing, is an elongate support structure of generally rectangular transverse cross-sectional profile. That is to say, the profile taken perpendicular to the elongate direction is rectangular although there may be small departures from the rectangular shape, for example, for rounded or chamfered corners, decorative ribbing or for other ornamental, structural or manufacturability purposes, and thus the profile is referred to as generally rectangular. The support member is generally hollow either along its entire length or at least along a portion of the length interrupted perhaps by screws or bolts for attaching the head brackets or tripod. The generally rectangular shape provides for structural integrity and provides adequate interior space to store at least one, and generally two spare halogen bulbs in side-by-side relation.

In the embodiment illustrated in FIG. 1 the spare bulb holder is disposed in an end 13 of cross bar 11. FIG. 1 shows a pair of spare bulb retainers 14 and 15 mounted in end 13. Spare bulb retainer 14 is partially withdrawn from the cross bar for visibility. For clarity the electrical cords to heads 10 have been omitted from FIG. 1 as they do not contribute to the elucidation of the invention.

Figure 2:
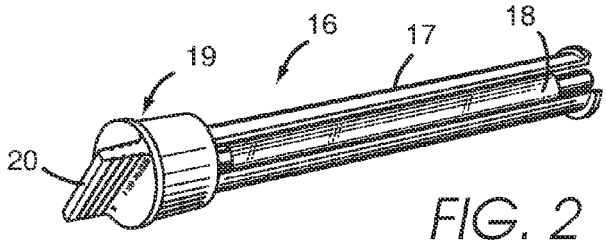
FIG. 2 is a perspective view showing a spare bulb retainer holding a spare halogen bulb.

FIG. 2 shows a form of spare bulb retainer 16 of the type used in known worklights. See, for example, U.S. Pat. No. 6,050,710 of Grossman et al. discussed above. Spare-bulb retainer 16 in the illustrated embodiment has a round tubular section of generally elongate extent 17 formed and sized to hold a double-ended elongate halogen bulb 18. Tubular section 17 is typically formed of plastic and has a gap along its length as shown in FIG. 2. The end of retainer 16 is provided with an end cap 19 with a protruding tab 20 that the user can grasp to pull the retainer out of the spare bulb holder.

Figure 3:
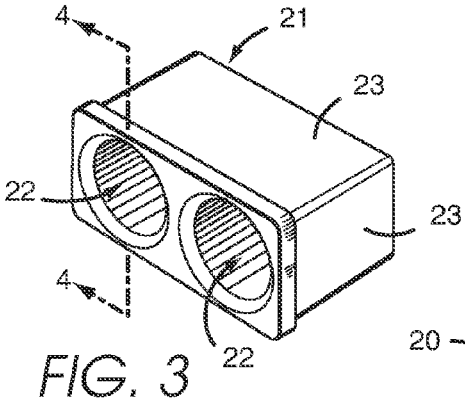
FIG. 3 is a perspective view of a retainer support piece.

FIG. 3 shows a retainer support piece 21 with two openings 22 sized so that a spare-bulb retainer tubular section 17 can be inserted through the opening into the hollow interior of the structural support member, that is, into the interior of cross bar 11. End cap 19 and openings 22 are sized and shaped so that the end cap is received snugly in an opening 22 and closes off the opening.

Figure 4:
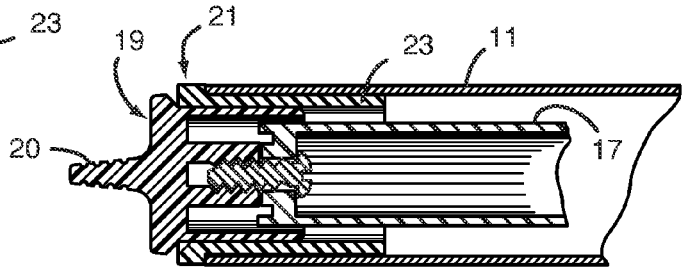
FIG. 4 is a cross-sectional view of a worklight cross bar with spare-bulb retainer held therein.

FIG. 4 shows a cross-sectional view of retainer support piece 21 taken along the line 4-4 in FIG. 3, with the retainer support piece inserted into the end of cross bar 11 and with a spare bulb retainer 16 disposed in storage position in the retainer support piece, but without a spare bulb in the retainer 16. The walls 23 of retainer support piece 21 are of rectilinear transverse profile generally mating with the transverse profile of the cross bar so that the walls are snugly received within the cross bar. The openings 22 are defined by round tubular members formed within the walls 23 and are sized to support the retainers 16 at the end cap 19.

The retainer support piece can be formed very simply and inexpensively of molded plastic so that through the simple expedient of providing a molded plastic end piece, and without the need for any other changes in the structure of the worklight, a spare-bulb storage unit is created as an integral part of the worklight. For the typical cross bar dimensions used with a dual-head worklight the spare-bulb holder can conveniently be formed to provide storage for two spare bulbs in side-by-side parallel relation.

The above descriptions and drawings are given to illustrate and provide examples of various aspects of the invention in various embodiments. It is not intended to limit the invention only to these examples and illustrations. Given the benefit of the above disclosure, those skilled in the art may be able to devise various modifications and alternate constructions that although differing from the examples disclosed herein nevertheless enjoy the benefits of the invention and fall within the scope of the invention, which is to be defined by the following claims. Any limitation in the claims expressly using the word "means" is intended to be interpreted as a "means plus function" limitation in accordance with Title 35, United States Code, Section 112, and any claim limitation not expressly using the word "means" is not intended to be so interpreted.

What is claimed is:

1. A worklight with integral spare bulb holder, the worklight including one or more worklight heads and a base supporting said one or more heads, the base including a generally hollow elongate cross bar structural support member of generally rectangular transverse cross-sectional profile, and the worklight utilizing one or more double-ended elongate halogen bulbs, wherein the improvement comprises:

a spare bulb holder disposed in said generally hollow elongate cross bar structural support member for holding at least one spare of said bulbs, comprising:

a spare-bulb retainer having an elongate extent and being formed to hold an individual said spare bulb, said retainer having an end cap at one end hereof and a retainer support piece disposed in an end of said cross bar structural support member, said retainer support piece being formed with two openings in side by side relation, each said opening being sized for said retainer to be inserted therethrough into said cross bar structural support member, whereby said spare bulb holder is able to hold two said spare bulbs in generally parallel relation to one another in said cross bar structural support member;

wherein said retainer support piece further comprises an insert having a generally rectangular transverse cross-sectional profile substantially mating with the generally rectangular transverse cross-sectional profile of said structural member, said insert being formed and sized to extend into said generally hollow structural member and to fit snugly therein, and wherein said retainer support piece is further formed with two tubular members extending into said generally hollow structural member from said two openings, each of said tubular members being formed and sized to snugly receive said end cap, whereby said retainer is held in said cross bar structural support member.

* * * * *